US009670607B2

(12) United States Patent
Schneider et al.

(10) Patent No.: US 9,670,607 B2
(45) Date of Patent: Jun. 6, 2017

(54) SLIDE NEEDLE

(71) Applicant: Groz-Beckert KG, Albstadt (DE)

(72) Inventors: Jürgen Schneider, Balingen (DE); Andreas Dietz, Astrid Meadows (SG)

(73) Assignee: GROZ-BECKERT KG, Albstadt (DE)

( * ) Notice: Subject to any disclaimer, the term of this patent is extended or adjusted under 35 U.S.C. 154(b) by 0 days.

(21) Appl. No.: 14/892,760

(22) PCT Filed: May 21, 2014

(86) PCT No.: PCT/EP2014/060471

§ 371 (c)(1),
(2) Date: Feb. 16, 2016

(87) PCT Pub. No.: WO2014/187872

PCT Pub. Date: Nov. 27, 2014

(65) Prior Publication Data

US 2016/0160411 A1 Jun. 9, 2016

(30) Foreign Application Priority Data

May 22, 2013 (DE) ..... 10 2013 105 239

(51) Int. Cl.
*D04B 35/06* (2006.01)

(52) U.S. Cl.
CPC ..... *D04B 35/06* (2013.01)

(58) Field of Classification Search
CPC ..... D04B 35/06; D04B 35/02
USPC ..... 66/116, 120
See application file for complete search history.

(56) References Cited

U.S. PATENT DOCUMENTS 1,673,634 A * 6/1928 Page ..... D04B 35/06 66/120
2,775,108 A * 12/1956 Bellini ..... D04B 27/06 66/120
3,584,481 A * 6/1971 Hayashi ..... D04B 35/06 66/120

(Continued)

FOREIGN PATENT DOCUMENTS

CN 101324010 A 12/2008
CN 102031633 A 4/2011

(Continued)

OTHER PUBLICATIONS

International Search Report in corresponding International Application No. PCT/EP2014/060471, dated Jul. 21, 2015, 4 pages.

(Continued)

*Primary Examiner* — Danny Worrell
(74) *Attorney, Agent, or Firm* — Fitch, Even, Tabin & Flannery LLP

(57) ABSTRACT

A slide needle, comprising a needle body, which has a needle hook with two spaced-apart lateral hook surfaces. A slide is movably arranged on the needle body between an initial position (I) and a stitch knock-over position (II). The slide has two slide blades. A hook hole on a free blade end of the slide blades is formed by inner hole surfaces. In the stitch knock-over position (II), each inner hole surface lies against an associated lateral hook surface of the needle hook at a contact location and the contact area between the slide and the needle hook is reduced in a height direction (H).

15 Claims, 7 Drawing Sheets

(56) References Cited

U.S. PATENT DOCUMENTS

| | | | | |
|---|---|---|---|---|
| 4,043,153 | A * | 8/1977 | Lindner | D04B 35/06 66/120 |
| 5,937,673 | A * | 8/1999 | Shima | D04B 35/06 66/120 |
| 6,233,977 | B1 * | 5/2001 | Schuler | D04B 35/06 66/120 |
| 6,339,942 | B1 * | 1/2002 | Majer | D04B 35/32 66/116 |
| 6,389,848 | B1 | 5/2002 | Kyoutani | |
| 6,422,045 | B1 | 7/2002 | Morita | |
| 6,510,712 | B2 | 1/2003 | Baseggio | |
| 6,546,761 | B2 * | 4/2003 | Ruoff | D04B 35/06 66/120 |
| 6,568,223 | B1 * | 5/2003 | Morita | D04B 35/06 66/116 |
| 6,598,430 | B2 * | 7/2003 | Ruoff | D04B 35/06 66/120 |
| 6,904,774 | B2 | 6/2005 | Morita | |
| 6,915,667 | B2 * | 7/2005 | Morita | D04B 35/32 66/120 |
| 7,930,906 | B2 * | 4/2011 | Dietz | D04B 35/06 66/120 |
| 8,578,740 | B2 * | 11/2013 | Schneider | D04B 35/06 66/120 |
| 2008/0307832 | A1 | 12/2008 | Weihing | |

FOREIGN PATENT DOCUMENTS

| | | | |
|---|---|---|---|
| CN | 201933277 | U | 8/2011 |
| CN | 102373573 | A | 3/2012 |
| CN | 102822403 | A | 12/2012 |
| DE | 60018760 | T2 | 9/2005 |
| DE | 60207454 | T2 | 7/2006 |
| DE | 60132233 | T2 | 4/2008 |
| DE | 60037246 | T2 | 10/2008 |
| EP | 1640489 | A1 | 3/2006 |

OTHER PUBLICATIONS

German Language International Patentability Report in corresponding International Application No. PCT/EP2014/060471, dated Apr. 17, 2015, 12 pages; indicating novelty and inventive step for claims as amended via PCT Article 34.

Office Action/Search Report and machine translation in corresponding German application No. 10 2013 105 239.8, dated Jan. 25, 2016, 2 pages.

Office Action and Search Report in corresponding Chinese Application No. 201480029432.3, dated Dec. 27, 2016, 8 pages.

Written Opinion of the International Search Authority in corresponding International Application No. PCT/EP2014/060471, dated Nov. 22, 2015, 11 pages.

* cited by examiner

SLIDE NEEDLE

CROSS REFERENCE TO RELATED APPLICATIONS

This patent application is the national phase of PCT/EP2014/060471 filed May 21, 2014, which claims the benefit of German Patent Application No. 10 2013 105 239.8 filed May 22, 2013.

TECHNICAL FIELD

The invention relates to a slide needle, in particular for stitch-forming textile machines, for example a knitting needle.

BACKGROUND

The slide needle has a needle body. The needle body can be arranged in a guide groove of a needle bed of the textile machine so that its base surface lies against the groove base or against one guide surface in the guide groove. A needle hook is provided on the free end of the needle body. The needle hook extends in an arcuate manner up to a hook tip and thus delimits an inner hook region.

A slide of the slide needle is supported so as to be movable relative to the needle body. To accomplish this, a guide means is provided. For example, a groove may be provided on the needle body or on the slide, in which groove the respectively other part comes into engagement. Preferably, a slide groove for the accommodation of the slide is provided on the needle body. The slide can be moved into a closed position so that it closes the inner hook region. The slide is in such a closed position in the stitch knock-over position. In a retracted position of the slide that may be referred to as the initial position, the inner hook region is open and a stitch can be picked up from the needle hook in the inner region of the hook.

Such slide needles for stitch-forming textile machines have been known. For example, publication DE 600 18 760 T2 shows a slide needle having a slide formed by two slide blades. In the closed position of the slide, the two slide blades come into abutment on opposite sides of the needle hook. Each slide blade has a stitch bearing surface for holding one or more stitches. In the initial position of the slide, the two slide blades are spread apart away from each other and, in between, form a continuous accommodation slit for the needle hook.

A similar slide needle has also been known from publication DE 60 132 233 T2. The position of the two slide blades relate to each other in the retracted initial position and the slit for the accommodation of the needle hook between the slide bases in close position of the slide needles are not described in detail here.

Referring to the slide needle known from publication DE 600 37 246 T2 the technical problem of play between the two slide blades of the slide and the lateral flanks of the slide groove in the needle body has been solved by centering means. The centering means that are used are bent portions of the slide blade, so that the slide blades with the slide inserted in the slide groove will be tensioned against the lateral flanks of the slide groove.

Another slide needle has been disclosed by publication EP 1 270 785 A1. In that case, the slide comprises two slide blades that form on their ends associated with the needle hook a funnel widening toward the front in the direction of movement of the slide, in which case needle hook—with the slide closed—engages in said funnel. A large funnel is to be provided that—even with occurring wear—can securely grasp the needle hook in order to be able to close the slide needle.

It has been found that that, with slide needles, an irregular stitch pattern may form due to changes in the relative position between the slide and the needle hook in stitch knock-over position, i.e., similar as in the case of a needle stripe. The reason therefor is stitch widths having different dimensions.

SUMMARY

Therefore, it may be viewed as the object of the present invention to provide a slide needle which improves the stitch appearance and, in particular, makes possible a more uniform stitch size.

The slide needle has a needle body with a shank extending in longitudinal direction. A height direction extends at a right angle relative to the longitudinal direction. The needle body has a needle hook on its end, said needle hook being disposed for stitch formation. The needle hook delimits an inner needle region for the pickup of a stitch.

Adjoining a hook tip, the needle hook has a hook end section with two lateral hook surfaces. The two lateral hook surfaces are arranged at a distance from each other in transverse direction. The transverse direction is oriented at a right angle relative to the longitudinal direction and the height direction.

A slide consisting of two slide blades can be moved relative to the needle body, for example in a slide groove. The slide can be moved between an initial position, in which the interior space of the hook is opened, and a stitch knock-over position, in which the slide is in contact with the needle hook and closes the inner hook region.

For the stitch formation, one or more stitches can be held or born by the slide. For this purpose, each slide blade has a stitch bearing surface. The stitch bearing surface is on the upper side of the respective slide blade. A hook opening is provided between the two slide blades. The hook opening is formed between the free blade ends. The hook opening is open in longitudinal direction in the initial position of the slide and thus relative to the hook tip of the needle hook.

The hook opening is delimited in transverse direction by two opposing inner opening surfaces. One inner opening surface is provided on each slide blade. In stitch knock-over position, the needle hook engages in the hook opening. In so doing, in particular the inner opening surfaces lie against a respectively associate lateral hook surface. In this stitch knock-over position, a gap exists between each inner opening surface and the associate lateral hook surface. The gap has a gap width in transverse direction. This gap width changes in height direction. Viewed in cross-section through the hook and the slide blades, the gap thus has the shape of a triangle or a wedge.

Due to this embodiment, it is possible to achieve a uniform stitch size. Deviations in the relative position of the slide or the blade ends of the two slide blades in height direction relative to the needle hook are minimized. The result is an improved stitch pattern.

Preferably, each slide blade in stitch knock-over position is in linear contact with a contact point on the needle hook. As a result of this, it is possible to reduce, in height direction, the frictional force components occurring between the needle hook and the slide blade during a relative movement from the initial position into the stitch knock-over position.

The linear contact at the contact point between a inner opening surface and the associate lateral hook surface is understood to mean a contact that displays a greater dimension in longitudinal direction than in height direction H. In particular, the dimension of the linear contact in longitudinal direction L in the stitch knock-over position is greater in height direction H by at least by the factor of 5 to 10.

The hook opening has a opening width in transverse direction between the two inner opening surfaces. In an inventive embodiment, the gap width that changes in height direction in the stitch knock-over position is formed by a opening width changing in the initial position and in the stitch knock-over position in height direction. Preferably, the opening width enlarges in height direction, viewed from the upper side of the slide, in the direction toward the shank. Therefore, the hook opening, viewed from the from the front in longitudinal direction, has a funnel-shaped or wedge-shaped form that widens in height direction downward toward the shank. The two lateral inner opening surfaces on the respective blade end of a slide blade, said inner opening surfaces delimiting the hook opening, are thus not parallel to each other but are arranged obliquely inclined to each other. This embodiment of the hook opening results in an inclined orientation of the two slide blade ends or at least the two inner opening surfaces relative to the longitudinal center plane through the slide needle. Consequently, the gap width of the two gaps changes in height direction, said gaps being formed in stitch knock-over direction between the two lateral hook surfaces and the inner opening surface in contact with the inner opening surface at the contact point.

Alternatively or additionally to the changing opening width, the gap width that changes in height direction in stitch knock-over position can also be achieved by a hook width of the hook end section that changes in height direction. For example, the two lateral hook surfaces may extend in an oblique manner relative to each other. Preferably, the hook width decreases in height direction toward the inner hook region. This also allows a linear contact at the contact point in the stitch knock-over position, said contact being between one respective inner opening surface and the associate lateral hook surface.

On a free blade end of each slide blade, the stitch bearing surface may transition into an end flank. This end flank may be provided on an end projection of the slid blade. The end flank extends in a direction obliquely or transversely to the stitch bearing surface and thus forms a stop for a stitch that is present on the stitch bearing surface.

In their initial position, with the inner region of the hook open, the two slide blades preferably lie against each other at a contact point. In so doing, the contact point is, in particular, directly adjacent to the end flanks of the two slide blades. The stitch held on the stitch bearing surface is not widened by the slide blades that lie against each other. The width of the slide in a transverse direction transversely to the longitudinal direction is thus minimal in the initial position of the slide. At the contact point where the two slide blades lie against each other in initial position, the hook opening is thus preferably closed and thus forms at least no fully passable slit between the two slide blades.

The end flanks on the two blade ends of each slide blade can be provided on an end projection. Viewed in height direction, this end projection may have a maximum. Each of the end flanks are the continuation of a respectively associate stitch bearing surface of the slide blade along the end projection and extend up to the maximum. In their initial position, with the inner hook region open, the two blade ends are preferably in contact along the entire end flanks. Consequently, viewed from the top onto the slide, the two blade ends lie against each other at least up to a maximum, without a gap that is open toward the hook opening.

Advantageously, the stitch bearing surface of each slide blade is delimited on the end opposite the blade end by a support flank extending transversely or obliquely to the stitch bearing surface. Consequently, the stitch bearing surface or a stitch bearing region on each slide blade is delimited, on the one hand, by the end flank on the end projection and, on the other hand, by the support flank; and the inadvertent slipping down of stitches from the slide is avoided.

The wall thickness of the slide blades in the region of the hook opening may be smaller than at the points where the slide blades do not adjoin the hook opening. As a result of this, it is possible to implement overall thin slide blades. The hook opening can thus be formed by a reduction of the wall thickness.

In order to achieve a opening width that changes in height direction, it is possible in an exemplary embodiment to reduce the wall thickness of the slide blades in the region of the hook opening in height direction from the upper side away toward the shank. As a result of this, the width of the hook opening increasing downward in height direction is achieved.

The shape of the slide blades, in particular in the region of the hook opening, can be achieved by a deformation process without material-ablating machining. As a result of this, material is saved. Furthermore, due to the deformation process, a hardening, preferably strain-hardening, can be achieved in the region of the hook opening, so that a sufficient strength of the slide blades is achieved even adjacent the hook opening where a lower wall thickness may exist.

Alternatively or additionally thereto, it is also possible to attain the hook opening by material-ablating, for example cutting, machining of the slide blades or the two blade ends.

Each of the lateral hook surfaces can be formed, for example, by a recess or flattening on the needle hooks.

The lateral hook surfaces may be planar surfaces that, in one exemplary embodiment, may be oriented parallel to each other, so that the cross-section of the hook changes in height direction in the hook end section. Preferably, the needle hook tapers toward the inner hook region in the hook end section due to the non-parallel lateral hook surfaces. In this embodiment, the gap width that changes in height direction can thus be achieved due to the changing hook width. In so doing, the two inner opening surfaces can also be oriented relative to each other in such a manner that the opening width does not change in height direction.

Advantageous embodiments of the invention can be inferred from the dependent patent claims, as well as from the description. The description is restricted to essential features of the invention. The drawings are to be used for supplementary reference. Hereinafter, exemplary embodiments of the invention are explained in greater detail with reference to the appended drawings. They show in

DETAILED DESCRIPTION

Figure 1:
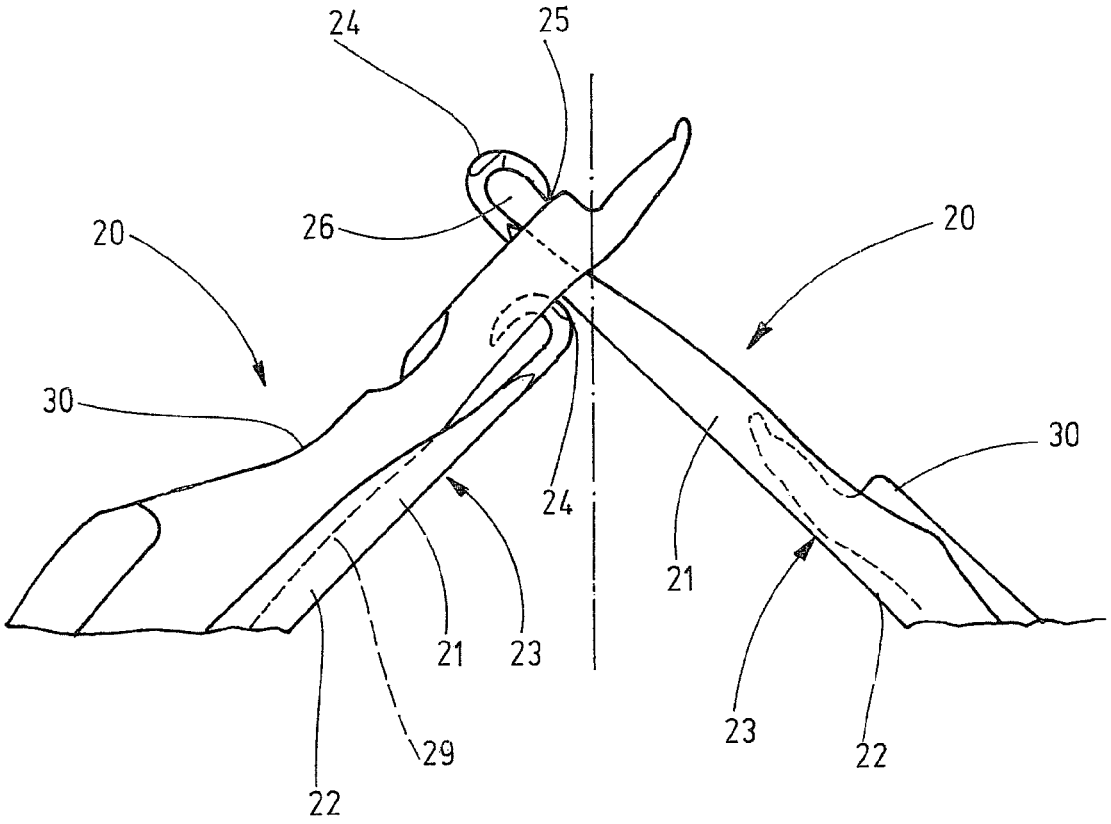
FIG. 1 a schematic diagram of two slide needles in a position for stitch formation in a not illustrated textile machine.

The invention relates to a slide needle 20 having a needle body 21. The needle body 21 has a shank 22, at which—preferably at least in sections—a flat base surface 23 is provided. The shank 22 extends in longitudinal direction L. The height direction H is usually perpendicular to the flat section (or to one of the planar sections) of the base surface 23. The base surface 23 is provided on a narrow side of the slide needle 20. The slide needle 20 is disposed to be arranged in a groove in a stitch-forming textile machine, for example a knitting machine. In so doing, the base surface 23 is supported by the groove base or by a support arranged in the groove of the textile machine. The drawing does not show the textile machine itself. FIG. 1 shows two slide needles 20 such as may be arranged in a textile machine. During the knitting process, the slide needles 20 are being moved back and forth in the groove.

At a stitch-forming end of the slide needle 20, the shank 22 transitions into a needle hook 24. The needle hook 24 extends in an arcuate manner up to the needle tip 25 that is arranged at a distance from the base surface 23 in height direction H. The height direction H is oriented at a right angle with respect to the base surface 23 of the needle body 21. On its inside, the arcuate needle hook 24 delimits an inner hook region 26.

Adjoining its hook tip 25, the needle hook 24 has a hook end section 27 on which two spaced-apart lateral hook surfaces 28 are formed in transverse direction Q. The transverse direction Q is oriented at a right angle relative to a longitudinal center plane through the slide needle 20. The transverse direction Q, the height direction H and the longitudinal direction L are oriented so as to be at right angles with respect to each other.

Figure 13:
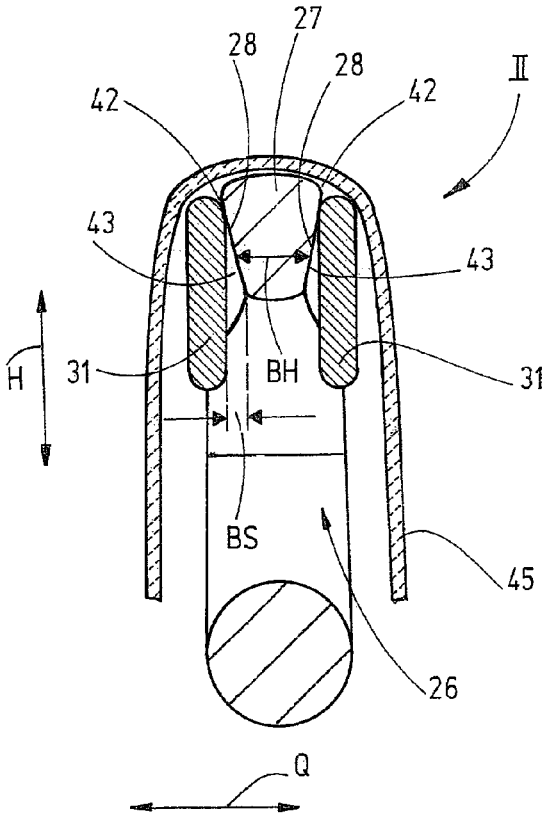
FIG. 13 a sectional view of an inventive embodiment of the slide needle in the machine knock-over position in the region of the needle hook.
Figure 14:
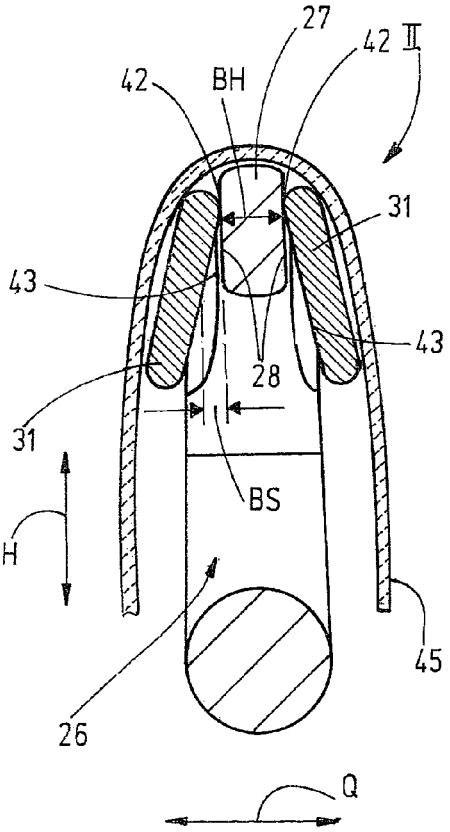
FIG. 14 a sectional view of a needle hook having a modified hook shape.

The two lateral hook surfaces 28 may be configured as planar surfaces as is the case in the exemplary embodiment (compare, in particular, FIGS. 13 and 14). The two lateral hook surfaces 28 may be oriented parallel to height direction H (FIG. 13). Alternatively, it is possible for the two lateral hook surfaces 28 to extend obliquely in height direction H. In so doing, the hook width BH of the hook end section 27 is not constant in height direction H. The needle hook 24 may taper in the region of the hook end section 27 toward the inner hook region 26 (FIG. 14). In this case, the cross-sectional contour of the hook end section 27 is approximately trapezoidal, wherein the side facing the inner hook region 26 and the side facing away from the inner hook region 26 are configured in a convex manner and are connected by the preferably flat or planar lateral hook surfaces 28.

The needle body 21 has a slide groove 29, in which a slide 30 can be moved toward the needle hook 24 or away from the needle hook 24, and is preferably arranged so it may be slid back and forth and/or be pivotable. The exact course of movement of the slide 30 during its movement inside the slide groove 29 depends on the course of the slide groove 29 or the contour of the underside of the slide 30 associated with the groove 29. The movement need not be linear.

Figure 2:
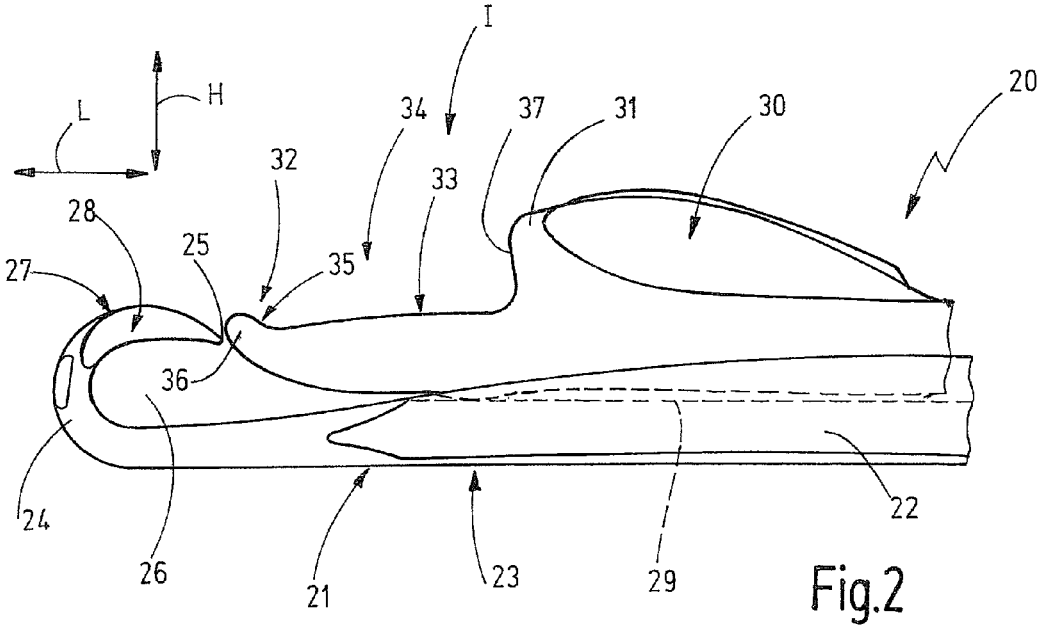
FIG. 2 a partial view, in side elevation, of an exemplary embodiment in a slide needle.
Figure 15:
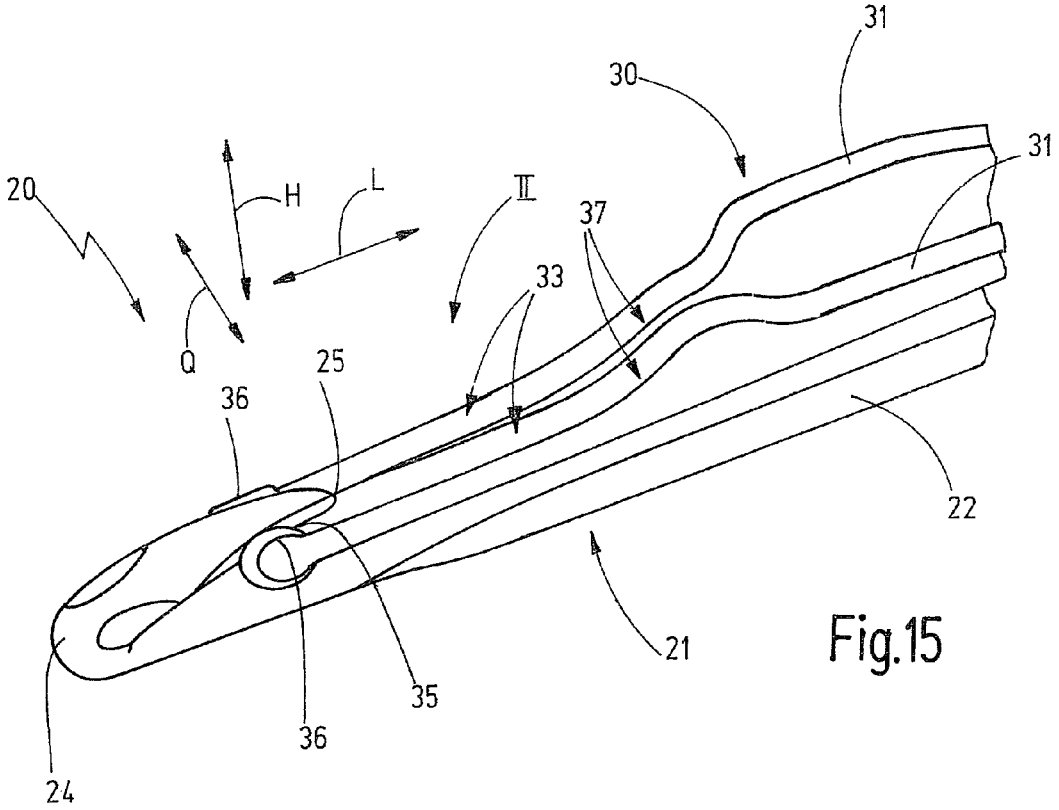
FIG. 15 a perspective illustration of an inventive slide needle in accordance with all embodiment shapes in the machine knock-over position.
Figure 16:
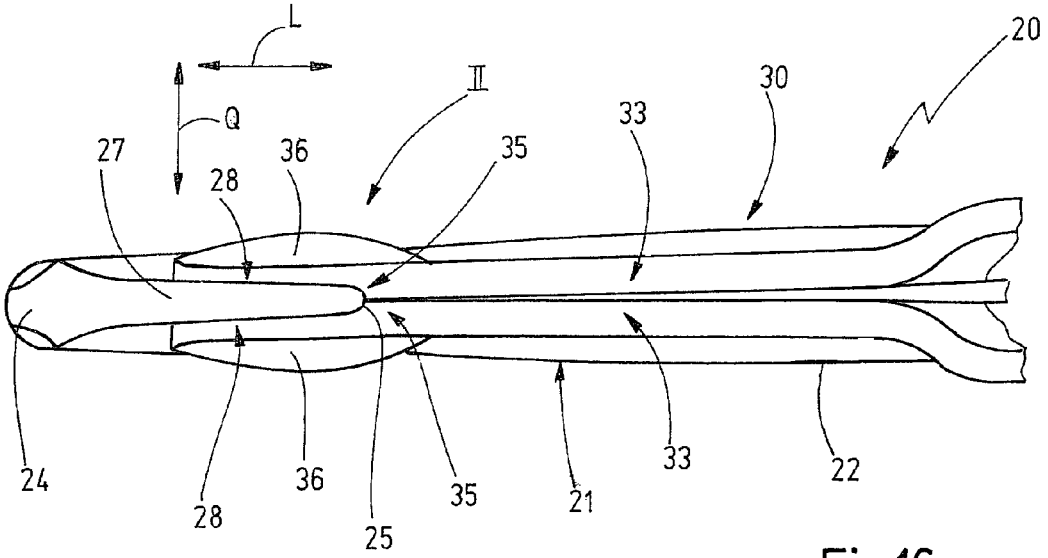
FIG. 16 a plan view onto the stitch bearing surfaces on the upper side of the slide of the slide needle as in FIG. 15.

The slide 30 of the slide needle 20 can be moved between and initial position I (FIGS. 2, 3 and 8) and a stitch knock-over position II (FIGS. 15 and 16) relative to the needle body 21. It is also possible to move the slide 30 beyond the stitch knock-over position II, as is shown, for example, in FIG. 1.

As an alternative to the preferred embodiment, it is also possible that instead of the slide groove 29 in the needle body 21, a groove can be provided in the slide 30 where a projection of the needle body 21 comes into engagement. It is also possible to provide other guide means for the movable support of the slide 30 on the needle body 21, different from the preferred embodiments illustrated here.

In the initial position I, the slide 30 is not in contact with the needle hook 24. The inner hook region 26 delimited by the needle nook 24 is thus not completely closed. In the stitch knock-over position, the slide 30 is in abutment with the hook 24, so that the inner hook region 26 is closed by the slide 30.

The slide 30 consists of two separate slide blades 31. Both slide blades 31 have essentially the same configuration. The slide 30 is configured symmetrically relative to a longitudinal center plane through the slide needle 20.

Each slide blade 31 has a free blade end 32. This free blade end 32 is associated with the needle hook 24, and the slide blades 31 contact the blade end 32 on the needle hook 24 in stitch knock-over position II.

Adjoining the blade end 32, each slide blade 31 has a stitch bearing surface 33. The stitch bearing surface 33 is provided by the narrow side of the slide blade 31 on the upper side 34 of the slide 30. The stitch bearing surface 33 extends in longitudinal direction L. The stitch bearing surface 33 may be oriented at a right angle relative to the height direction H or extend obliquely relative to the transverse direction Q.

Figure 4:
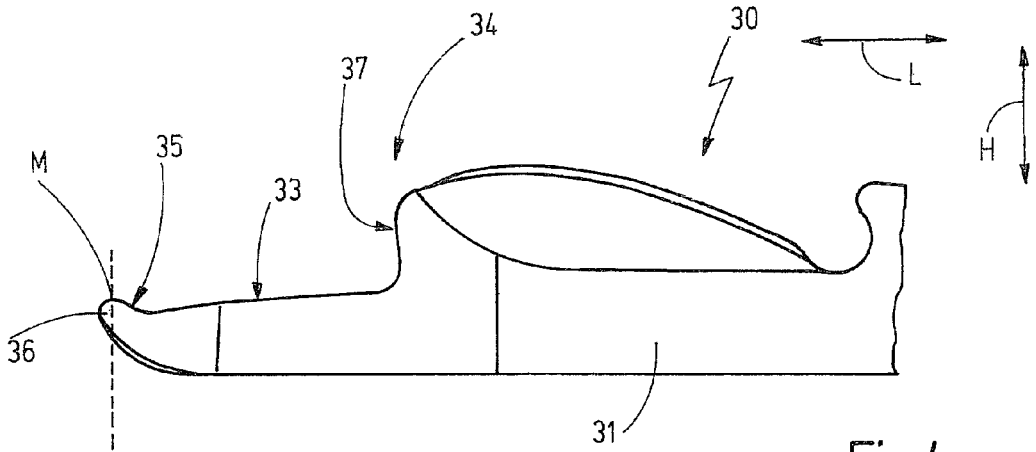
FIG. 4 a partial view, in side elevation, of the slide of the slide needle as in FIGS. 2 and 3.
Figure 5:
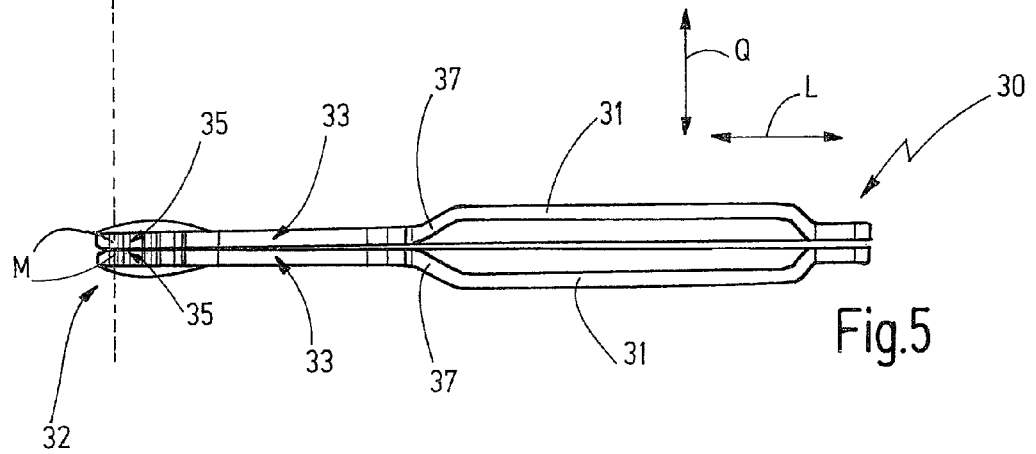
FIG. 5 a plan view of the slide as in FIG. 4 in height direction on the stitch bearing surface of the slide.
Figure 6:
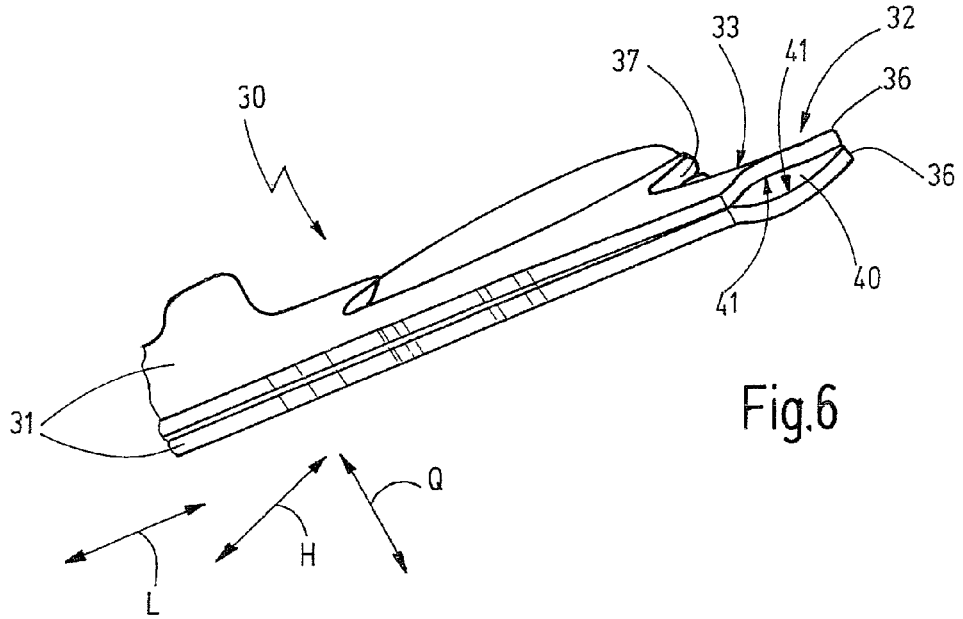
FIG. 6 a perspective partial illustration, looking at the hook opening of the slide as in FIGS. 4 and 5.
Figure 7:
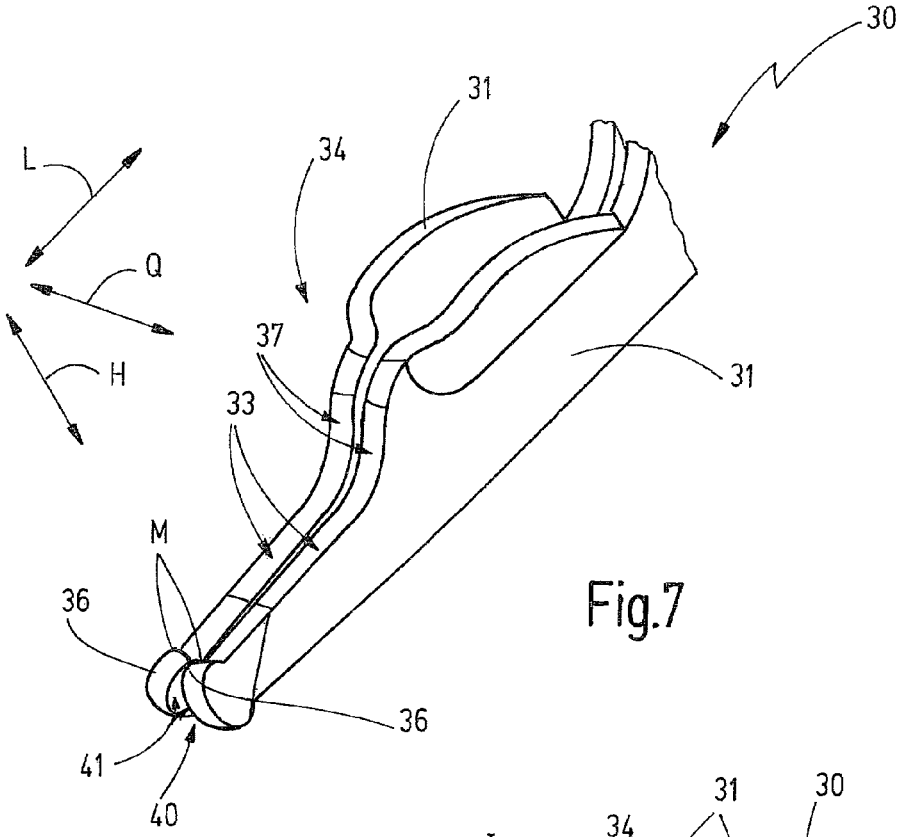
FIG. 7 a perspective partial illustration, looking obliquely from the front onto the blade ends, of the slide as in FIGS. 4 through 6.
Figure 11:
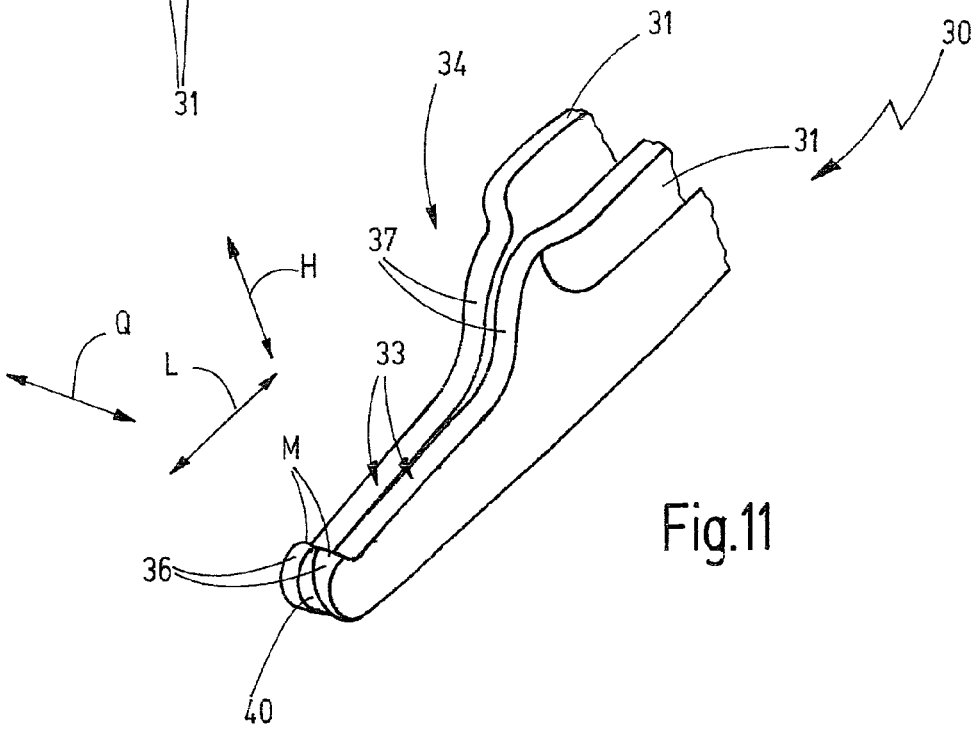
FIG. 11 a perspective partial illustration, looking obliquely from the front onto the blade ends, of the slides as in FIGS. 9 and 10.

The stitch bearing surface 33 is delimited on both side in longitudinal direction L. On the blade end 32 the stitch bearing surface of a slide blade 31 continues in an end flank 35 that extends obliquely inclined in height direction H and, at the same time, in longitudinal direction L. This end flank 35 is provided on an end projection 36 of the slide blade that extends up to a maximum M (e.g., FIGS. 4, 5 and 11). The maximum M represents a local maximum in a front region of the slide blade 31. In the height direction H, the maximum M is at a greater distance from the shank 22 than the end flank 35 and the stitch bearing surface 33 of the slide blade 31. In the region of the maximum M, the end projection 36 of the slide blade 31 is rounded.

On the side opposite the end projection 36 or the end flank 35, the stitch bearing surface 33 of each slide 31 is delimited by a support flank 37 that extends obliquely or transversely with respect to the stitch bearing surface 33. Consequently at least one stitch can be held on the stitch bearing surface 33 of the slide 30 between the end flank 35 of the end projection 36, on the one hand, and the support flank 37, on the other hand, during stitch formation.

Figure 3:
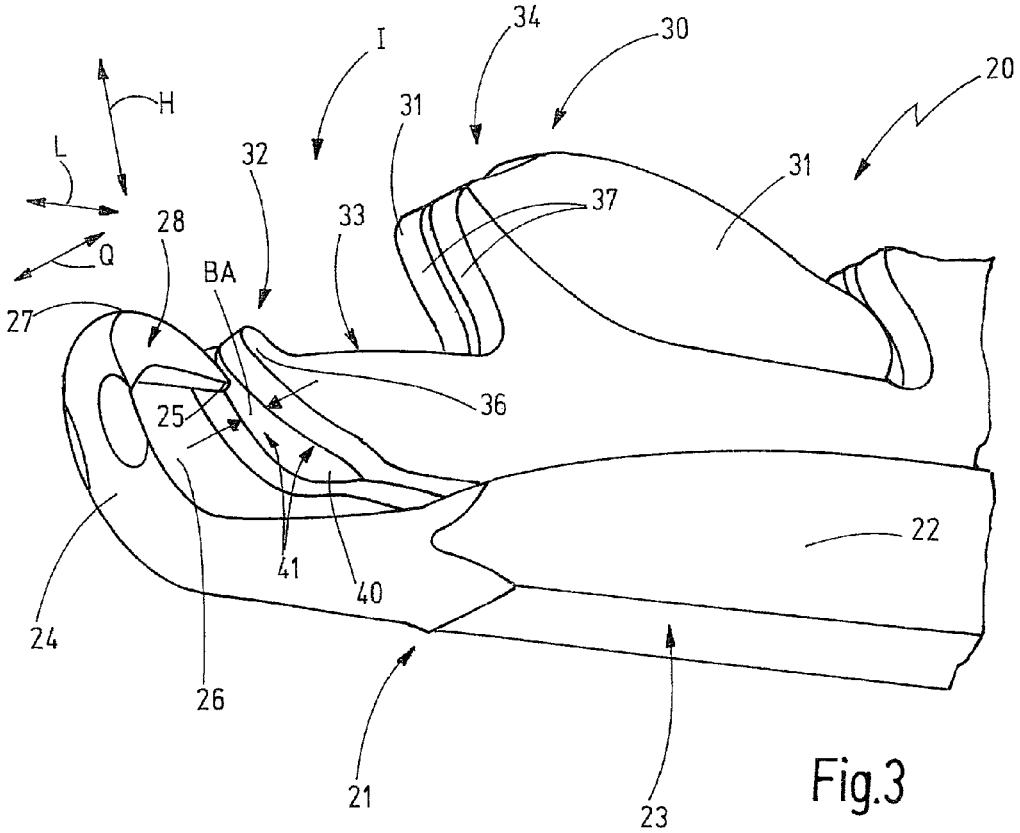
FIG. 3 a perspective illustration of the exemplary embodiment of the slide needle as in FIG. 2.
Figure 8:
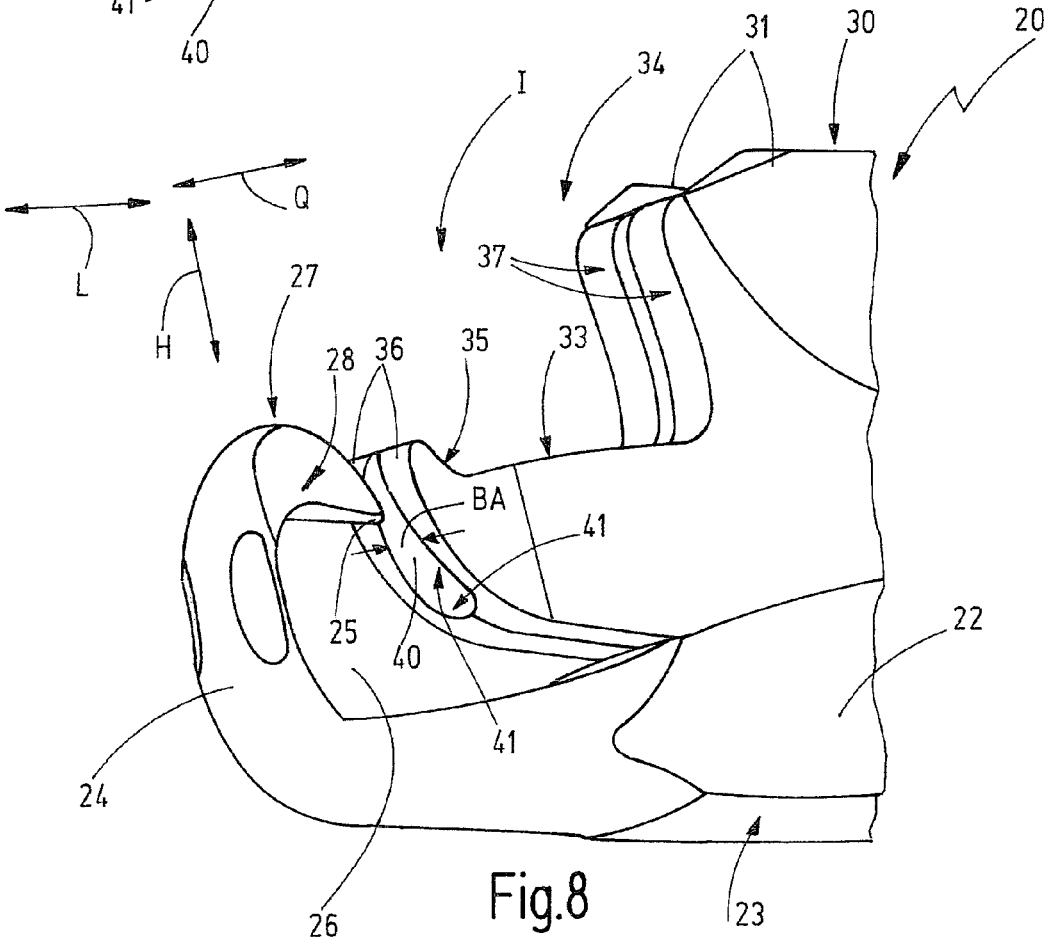
FIG. 8 a perspective partial illustration of a second exemplary embodiment of a slide needle with a modified slide.
Figure 9:
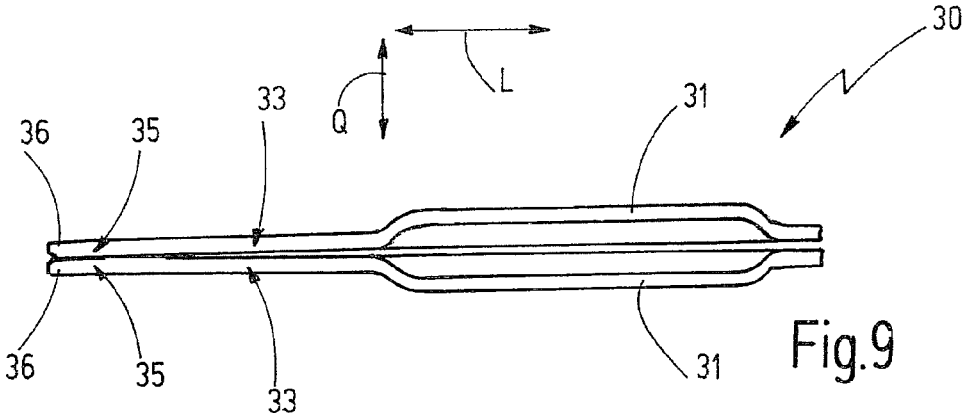
FIG. 9 a plan view, in height direction, onto the stitch bearing surface of the slide of the slide needle as in FIG. 8.
Figure 10:
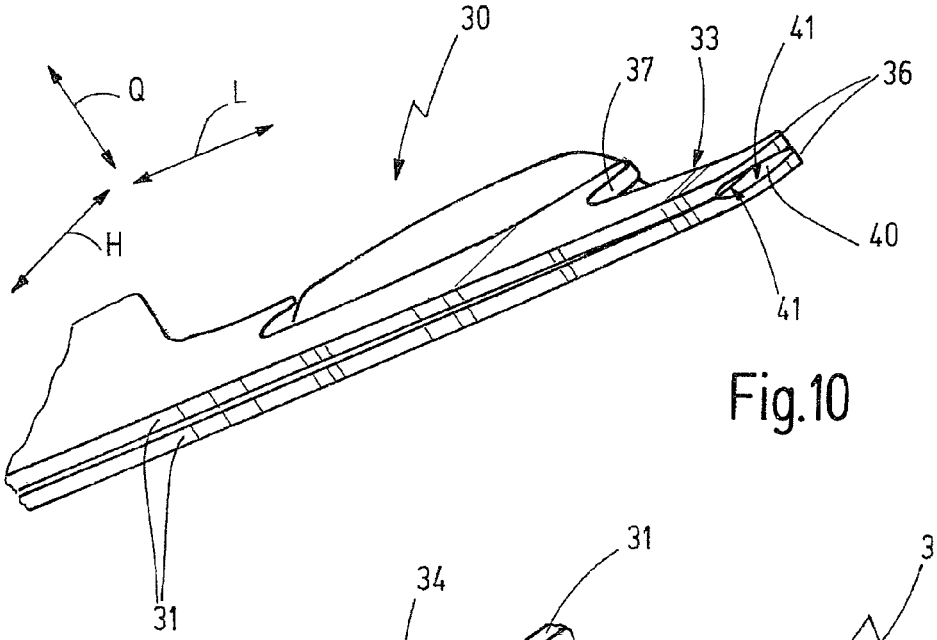
FIG. 10 a perspective partial illustration, looking onto the hook opening, of the slides as in FIG. 9.

A hook opening 40 is formed on the blade ends 32 between the two slide blades 31. The hook opening 40 is delimited by respectively one inner opening surface 41 on one of the two slide blades 31. The two inner opening surfaces 41 are at a distance opposite each other in transverse direction Q. The distance between these two inner opening surfaces 41 in transverse direction Q represents the opening width BA of the hook opening 40 (FIGS. 3 and 8).

In the stitch knock-over position II, each inner opening surface 41 is in contact with a respectively associate lateral hook surface 28 at a contact point 42. In so doing, a gap 43 is formed between the inner opening surface 41 and the associate lateral hook surface 28. Therefore, in stitch knock-over position II, respectively one gap 43 exists on both sides of the needle hook 24. These gaps 43 are illustrated in FIGS. 13 and 14.

In cross-section through the slide needle 20 and through the hook end section 27, the gap 43 is wedge-shaped or approximately triangular. In transverse direction Z, the gap 43 has a gap width BS. This gap width BS is shown, for example in FIGS. 13 and 14, at a point in height direction H. In accordance with the example, the gap width BS is not constant in height direction and decreases, viewed from the inner hook region 26, up to the contact point 42.

At the contact point 42 there is no planar but rather a linear contact due to the gap 43. Viewed in longitudinal direction L, the contact area is greater by a multiple than in height direction H. Therefore, the contact area at the contact point 42 in the stitch knock-over position II is greater in longitudinal direction L than in height direction H by at least the factor 5 to 10.

In order to achieve this gap 43 that changes its gap width BS in height direction H in the stitch knock-over position II, there are suggested two options according to the invention as illustrated by FIGS. 13 and 14. In one embodiment the hook width BH of the hook end section 27 changes in height direction H. In this exemplary embodiment, the two inner opening surfaces 41 are preferably arranged so as to be approximately parallel to each other, so that the opening width BH does not change in height direction in the region of the hook opening 40, in which the needle hook 24 in stitch knock-over position II engages in the hook opening 40. This basic solution is shown in FIG. 13.

Considering another inventive embodiment option, the hook width BH of the hook end section 27 may be constant in height direction H. In this exemplary embodiment, the opening width BA changes in height direction H at least in the region of the hook opening 40, in which the hook opening 40 comes into engagement. Also as a result of this, in stitch knock-over position II, a gap 43 is formed, said gap having a gap width BS that increases away from the contact point 42. As a result of this, the inner opening surfaces 41 lie against each other in a linear manner at the contact point 42 on the associated later hook surfaces 48.

The two solutions according to the invention as illustrated by FIGS. 13 and 14 may also be combined with each other. A cap 43 may also be formed in that the inner opening surfaces 41, due to the slide needle 20, extend inclined at a different angle than the two lateral hook surfaces 28, relative to a longitudinal center plane. Also in this case a gap 43 is formed, as has been described in conjunction with the examples of FIGS. 13 and 14.

This reduced contact area between the slide 30, or between the two slide blades, and the lateral hook surfaces 28 in stitch knock-over position II has the result that any friction can be reduced in the case of a relative movement between the slide 30 and the needle hook 24.

Figure 12:
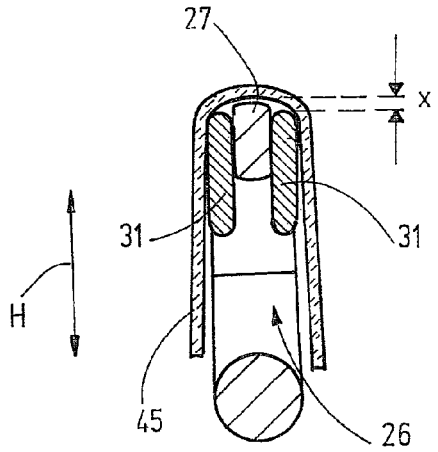
Fig.12 (Prior Art)
FIG. 12 a sectional view of a prior-art slide needle in the machine knock-over position in the region of the needle hook.

The relative movement between the slide 30 and the needle hook 24 is usually not exactly linear in longitudinal direction L, but this movement comprises a movement component in height direction H. During the movement of the slide 30 into the stitch knock-over position II, it is possible—due to friction occurring between the hook 24 and the slide blades 31—for deviations in the relative position to occur. In so doing, the height difference x between the ridge and the highest point of the needle hook 24, respectively, and between the blade end 32 and, in particular the maximum M on the end projection 34, is of particular importance (see FIG. 12). This height difference x is instrumental for widening a stitch 45. Due to a planar contact between the slide blades 31 and the lateral hook surfaces 28—in prior art (FIG. 12)—changes in the height difference x repeatedly occur during the stitch formation process. As a result of this, an irregular stitch pattern is formed, this being disadvantageous in view of quality, and needle stripe effects may occur.

In accordance with the invention such variations are at least minimized. Due to the decreasing contact area in the region of the contact points 42, the friction decreases between the hook 24 and the slide blades 31 during a relative movement. It has been found that, as a result of this, a more precise positioning in height direction H of the slide blades 31 relative to the hook end section 27 can be achieved, and the height difference x can be repeatedly adjusted highly accurately to a desired value. Differences in stitch size are reduced or do not occur, and a high-quality stitch pattern is formed.

Referring to the preferred exemplary embodiments illustrated here, the blade ends 32 of the two slide blades 31 are preferably in contact with each other at the end flanks 35. As an alternative to these shown preferred embodiments, it is also possible that, at least in sections, a gap exists between the two slide blades 31 in the region of the stitch bearing surface 33 or in the region of the end flanks 32.

Referring to the exemplary embodiment of the slide needle 20 or the slide 30 shown by FIGS. 2 to 7, the hook opening 40 is obtained by a deformation process of the two slide blades 31. Material-ablating or cutting machining of the slide blades 31 can thus be omitted in forming the hook opening 40. To form the hook opening 40, the slide blades 31 extend away from each other, so that the hook opening 40 is formed displaying the opening width BA increasing from the upper side 34 downward in height direction H. Alternatively or additionally, it would also be possible to produce the hook opening 40 by means of material-ablating or cutting machining of the slide blades 31.

In another exemplary embodiment of the slide needle 20 or the slide 30 in accordance with FIGS. 8 to 11, the hook opening 40 or the change of its opening width BA is accomplished by a change of the wall thickness of the slide blades 31 on the sections having the inner opening surfaces 41. The wall thickness which has been reduced for widening the hook opening 41 can be seen, in particular, in FIGS. 8 and 10. This wall thickness of the slide blades 31 changing in height direction H adjoining the inner opening surfaces 41 can be achieved by forming or by material-ablating or cutting machining.

It is also possible to reconfigure the hook opening 40 having a opening width BA extending in height direction by a combination of reduced wall thickness and sections of the slide blades 31 which are bent outward or reshaped relative to the longitudinal center plane in the region of the opening surfaces 41.

The invention relates to a slide needle 20, comprising a needle body 21, which has a needle hook 24. The needle hook has two lateral hook surfaces 28 arranged at a distance from each other in a transverse direction). A slide 30 is movably arranged on the needle body. The slide 30 has no contact with the needle hook 24 in an initial position I. The slide 30 lies against the needle hook 24 in a stitch knock-over position II. The slide 30 has two slide blades 31. These slide blades have a stitch bearing surface 33 for accommodating at least one stitch 45. A hook opening 40 open toward the hook tip 25 is present on a free blade end 32 of the slide blades. Inner opening surfaces 41 are arranged at a distance from each other in a transverse direction Q and thereby form the hook opening 40. In the stitch knock-over position (II), each inner opening surface 41 lies against an associated lateral hook surface 28 of the needle hook 24 at a contact point 42. A gap is formed 43 adjacent to the contact point 42 in a height direction H. The gap 43 has a gap width BS in the transverse direction Q that increases with distance from the contact point 42 in the height direction H. Thus, contact with the contact area between the slide 30 and the needle hook 24 that is smaller in the height direction H is achieved in the stitch knock-over position II.

LIST OF REFERENCE SIGNS

20 Slide needle
21 Needle body
22 Shank
23 Base surface
24 Needle hook
25 Hook tip
26 Inner hook region
27 Hook end section
28 Lateral hook surface
29 Slide groove
30 Slide
31 Slide blade
32 Blade end
33 Stitch bearing surface
34 Upper side of the slide blade
35 End flank
36 End projection
37 Support flank
40 Hook opening
41 Inner opening surface
42 Contact point
43 Gap
45 Stitch
BA Opening width
BH Hook width
BS Gap width
H Height direction
L Longitudinal direction
M Maximum
Q Transverse direction
X Height difference

The invention claimed is:

1. A slide needle (20) comprising:

a needle body (21 having a shank (22) extending in a longitudinal direction (L), said shank having a needle hook (24) on its end that is configured for stitch formation;

wherein the needle hook (24) includes a hook tip (25) and a hook end section (27) having two lateral hook surfaces (28) that are arranged in a transverse direction (Q) at a distance from each other, wherein the transverse direction (Q) is oriented transversely to the longitudinal direction (L);

a slide (30) that is supported by the needle body (21) so as to be movable toward and away from the needle hook (24);

wherein the slide (30) comprises two slide blades (31) each with an upper side (34) having a stitch support surface (33);

wherein the two slide blades (31) have free blade ends (32) each with an inner opening surface (41) that, together, delimit a hook opening (40) that is open toward the needle hook (24) in the longitudinal direction (L);

wherein the needle hook (24), in a stitch knock-over position (II), engages in the hook opening (40), wherein, between each of the inner opening surfaces (41) and the respectively associated lateral hook surfaces (28), a gap (43) is formed, said gap having, in the transverse direction (Q), a gap width (BS) that changes in a height direction (H), wherein the height direction (H) is oriented transversely to the longitudinal direction (L) and transversely to the transverse direction (Q); and each of the inner opening surfaces (41) in the stitch knock-over position (II) abut against the respectively associated lateral hook surfaces (28) establishing a contact that is greater in the longitudinal direction (L) than in the height direction (H).

2. The slide needle as in claim 1, wherein the hook opening (40) has, in the transverse direction (Q), an opening width (BA) that changes along the height direction (H).

3. The slide needle as in claim 2, wherein the opening width (BA) of the hook opening (40) increases along the height direction (H) downwardly from the upper side (34) toward the shank (22).

4. The slide needle as in claim 1 wherein the two lateral hook surfaces (28) are oriented parallel to each other.

5. The slide needle as in claim 1, wherein the hook end section (27) has, between the two lateral hook surfaces (28) in the transverse direction (Q), a hook width (BH) that changes along the height direction (H).

6. The slide needle as in claim 5, wherein the hook width (BH) decreases along the height direction (H) in the direction toward an inner hook region (26).

7. The slide needle as in claim 1, wherein the stitch support surface (33) terminates on the free blade end (32) of a respective slide blade (31) in an end flank (35) extending in an inclined manner or transversely to the stitch support surface (33).

8. The slide needle as in claim 7, wherein the respective free blade ends (32) of the two slide blades (31) abut against each other adjoining the adjacent end flanks (35) in an initial position (I) different from the stitch knock-over position (II) in which the slide (30) is not in contact with the needle hook (24).

9. The slide needle as in claim 1, wherein the stitch support surface (33) is delimited on the end opposite the free blade end (32) by a support flank (37) extending transversely or obliquely to the stitch support surface (33).

10. The slide needle as in claim 1, wherein the slide blades (31) have a wall thickness in a region of the hook opening (40) that is smaller, at least in sections, than at points where the slide blades (31) do not adjoin the hook opening (40).

11. The slide needle as in claim 1, wherein the hook opening (40) is formed by deformation of the two slide blades (31).

12. The slide needle as in claim 1, wherein the hook opening (40) is formed by material-ablating machining of the slide blades (31).

13. The slide needle as in one of the previous claims, wherein each of the inner opening surfaces (41) in the stitch knock-over position (H) abut linearly against the respectively associated lateral hook surface (28) at a single contact location (42).

14. The slide needle as in claim 1, wherein the lateral hook surfaces (28) are planar surfaces.

15. The slide needle as in claim 1, wherein a dimension of the contact in the stitch knock-over position (II) is greater in the longitudinal direction (L) than in the height direction (H) by at least a factor of 5.

* * * * *